US006237612B1

(12) United States Patent
Heyer

(10) Patent No.: US 6,237,612 B1
(45) Date of Patent: May 29, 2001

(54) TURN KEY COMPACT

(75) Inventor: Charles Heyer, Cerar Grove, NJ (US)

(73) Assignee: Jerhel Plastics Inc, Bayonne, NJ (US)

( * ) Notice: Subject to any disclaimer, the term of this patent is extended or adjusted under 35 U.S.C. 154(b) by 0 days.

(21) Appl. No.: 09/531,867

(22) Filed: Mar. 21, 2000

(51) Int. Cl.[7] ..... A45D 33/24; A45D 33/00; A45D 33/22

(52) U.S. Cl. ..... 132/294; 132/293; 132/295

(58) Field of Search ..... 132/294, 295, 132/296, 293, 305, 297, 300; 206/581, 823; 220/210, 284, 285

(56) References Cited

U.S. PATENT DOCUMENTS

| | | | | |
|---|---|---|---|---|
| 1,771,470 | * | 7/1930 | Wakefield | 132/294 |
| 5,346,085 | * | 9/1994 | Svensson et al. | 220/210 |
| 5,348,031 | * | 9/1994 | Cloud | 132/317 |
| 5,524,779 | * | 6/1996 | Faile | 215/207 |
| 5,735,297 | * | 4/1998 | Litton | 132/294 |
| 6,032,811 | * | 3/2000 | Marconi | 215/228 |
| 6,070,749 | * | 6/2000 | Joulia | 220/4.22 |

* cited by examiner

*Primary Examiner*—Gene Mancene
*Assistant Examiner*—Robyn Kieu Doan

(57) ABSTRACT

A cosmetic compact comprises a cover member having front and rear side edges. The cover member has a flat top surface and a recessed bottom surface having a lowered periphery with a downwardly projecting front extension and a first adjacent front opening. A base member has front and rear side edges, a flat bottom surface and a recessed horizontal top surface with a raised periphery. The raised periphery has a front slot with a second adjacent front opening. The base member has in its top surface an elongated recess spaced from the remaining portion of the top surface which communicates with the second adjacent opening. A hinge secures the rear edges of the cover and base members together. The front slot receives the front extension and the second adjacent opening meets the first adjacent opening to form a combined larger opening when the two members are closed, thereby closing the compact. A flat applicator element lies in flat horizontal position in said elongated recess with an integral flat horizontal head which extends out of the second opening when the compact is closed. The head is rotatable into vertical position while the two members are closed so that the rotated head extends out of the larger opening and forces the top member to pivot upward about the hinge and open the compact.

5 Claims, 2 Drawing Sheets

TURN KEY COMPACT

BACKGROUND OF THE INVENTION

Various types of cosmetic compacts containing cosmetic products utilize conventional release mechanisms such as pushbuttons or friction clasps for use in opening the compacts to expose the cosmetic product. The users employ separate applicator elements such as wands or brushes in applying the products.

The present invention is directed toward a new type of opening mechanism wherein the body of an applicator element is stored in the compact with an applicator head which extends outside of the compact and can be rotated as a key to open the compact and permit removal of the element for subsequent use in applying the product.

SUMMARY OF THE INVENTION

In accordance with the principles of this invention, a cosmetic compact employs a cover member having front and rear side edges. The cover member has a flat top surface and a recessed bottom surface having a lowered periphery. The lowered periphery has a downwardly projecting front extension and a first adjacent front opening.

The compact also employs a base member having front and rear side edges. The base member has a flat bottom surface and a recessed horizontal top surface with a raised periphery. The raised periphery has a front slot with a second adjacent front opening. The base member has in its top surface an elongated recess spaced from the remaining portion of the top surface and communicating with the second adjacent opening. Cosmetic product can be stored for use in this remaining portion. Both members have the same shape and size. The shape can be any polygon having at least four sides.

The compact has a hinge securing the rear edges of the cover and base members together. When the two members are closed, thereby closing the compact, the front slot engages the front extension and said second adjacent opening joins with the first adjacent opening to form a combined larger opening.

A flat applicator element which lies in flat horizontal position in the elongated recess has an integral flat horizontal head which extends out of said second opening when the compact is closed. The head is manually rotatable into vertical position while the two members are closed so that the rotated head extends out of the combined larger opening and forces the top member to pivot upward about the hinge and thereby open the compact in a unique manner. The element can then be removed from the base member and used to apply the cosmetic product in conventional manner.

These and other objects and advantages of this invention will either be explained or will become apparent hereinafter.

DETAILED DESCRIPTION OF PREFERRED EMBODIMENT

Figure 1:
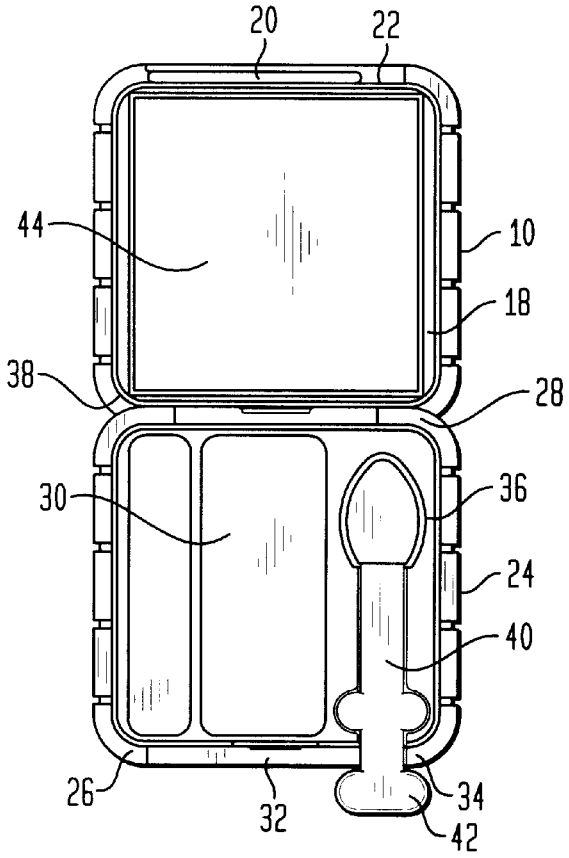
FIG. 1 is a top plan open view of a preferred embodiment of the invention.
Figure 2:
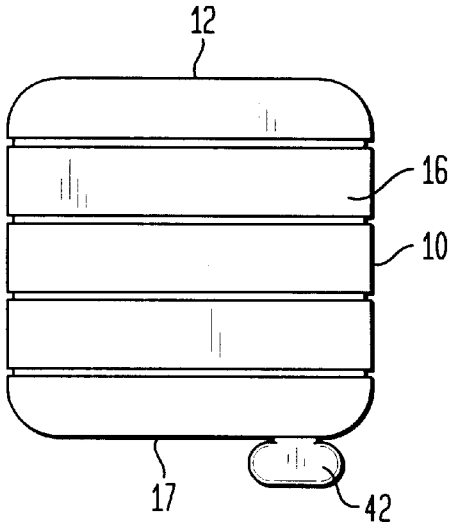
FIG. 2 is a top plan closed view thereof.
Figure 3:
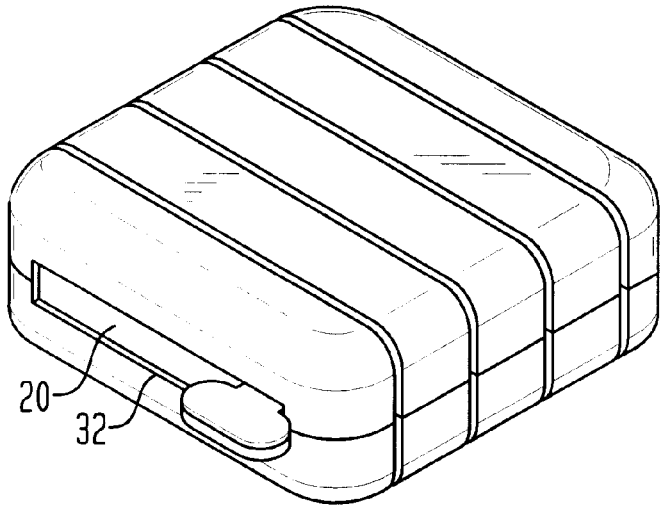
FIG. 3 is a perspective closed view thereof.
Figure 4:
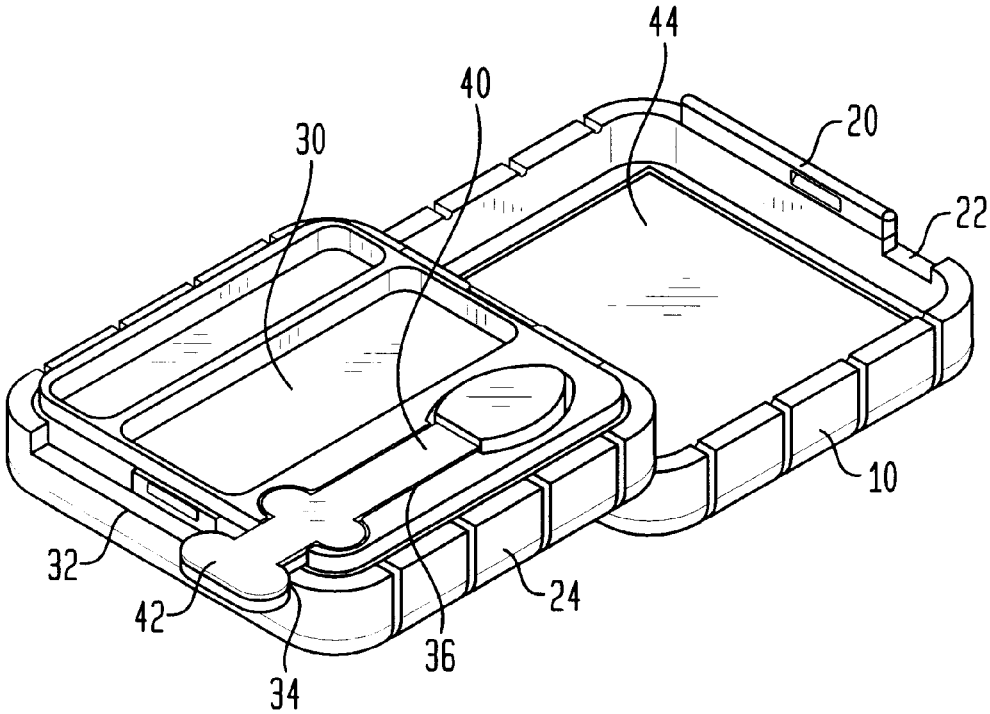
FIG. 4 is a perspective open view thereof.

Referring now to FIGS. 1–4, a cosmetic compact employs a cover member 10 having front and rear side edges 12 and

14. The cover member has a top surface 16 and a recessed bottom surface 18 having a lowered periphery with a downwardly projecting front extension 20 and a first adjacent front opening 22.

The compact also employs a base member 24 having front and rear side edges26 and 28. The base member has a flat bottom surface and a recessed horizontal top surface 30 with a raised periphery. The raised periphery has a front slot 32 with a second adjacent front opening 34. The base member has in its top surface an elongated recess 36 spaced from the remaining portion of the top surface and communicating with the second adjacent opening.

The base and cover members have the same shape, a polygon having two oppositely disposed edges and having at least four sides. In this preferred embodiment, a four sided polygon is shown.

A hinge 38 secures the rear edges of the cover and base members together.

The front slot receives said front extension and the second adjacent opening meets the first adjacent opening to form a combined larger opening when the two members are closed, thereby closing the compact.

A flat applicator element 40 lies in flat horizontal position in said elongated recess and has an integral flat horizontal head 42 which extends out of said second opening when the compact is closed. The head is rotatable into vertical position while the two members are closed so that the rotated head extends out of the larger opening and forces the top member to pivot upward about the hinge and thereby open the compact.

Cosmetic product may be contained in that portion of region 30 which is spaced from the elongated recess containing the removable element 4 which can function as a wand or can have a brush secured thereto to be used in applying the product. The recessed bottom surface of the cover member can support a mirror 44.

While the invention has been described with particular reference to the drawings and detailed description, the protection solicited is to be limited only by the terms of the claims that follow.

What is claimed is:

1. A cosmetic compact comprising:

a cover member having front and rear side edges, the cover member having a flat top surface and a recessed bottom surface having a lowered periphery with a downwardly projecting front extension and a first adjacent front opening;

a base member having front and rear side edges, the base member having a flat bottom surface and a recessed horizontal top surface with a raised periphery, said raised periphery having a front slot with a second adjacent front opening, the base member having in its top surface an elongated recess spaced from the remaining portion of the top surface and communicates with the second adjacent opening;

a hinge securing the rear edges of the cover and base members together;

said front slot receiving said front extension and said second adjacent opening meeting the first adjacent opening to form a combined larger opening when the two members are closed, thereby closing the compact, and a flat applicator element which lies in flat horizontal position in said elongated recess with an integral flat horizontal head which extends out of said second opening when the compact is closed, said head being rotatable into vertical position while the two members are closed so that the rotated head extends out of the larger opening and forces the top member to pivot upward about the hinge and thereby open the compact.

2. The compact of claim 1 wherein both members each have the same polygon shape, the polygon having at least four sides.

3. The compact of claim 2 wherein the remaining portion of the recessed top surface of the base member contains a cosmetic product which can be applied with a brush and said applicator has a brush portion spaced from said head.

4. The compact of claim 2 wherein the remaining portion of the recessed top surface of the base member contains a cosmetic product which can be applied with a wand and said applicator element is a wand.

5. The compact of claim 2 wherein the recessed bottom surface of the cover member contains mirror means.

* * * * *